United States Patent [19]

Austin

[11] Patent Number: 4,921,549

[45] Date of Patent: May 1, 1990

[54] PROMOTING DIRECTIONAL GRAIN GROWTH IN OBJECTS

[75] Inventor: Curtiss M. Austin, Warwick, N.Y.

[73] Assignee: Inco Alloys International, Inc., Huntington, W. Va.

[21] Appl. No.: 591,206

[22] Filed: Mar. 19, 1984

[51] Int. Cl.[5] ..... C21D 1/74

[52] U.S. Cl. ..... 148/13.1; 148/133

[58] Field of Search ..... 148/13.1, 14, 133, 145, 148/146, 404, 149, 11 RN

[56] References Cited

U.S. PATENT DOCUMENTS

| | | | |
|---|---|---|---|
| 1,925,116 | 7/1933 | Spence et al. | 148/149 |
| 3,063,816 | 11/1962 | Leidheiser, Jr. | 148/14 |
| 3,494,709 | 2/1970 | Piearcey | 416/232 |
| 3,615,927 | 10/1971 | Paulson | 148/149 |
| 3,746,581 | 7/1973 | Cairns et al. | 148/11.5 |
| 3,833,207 | 9/1974 | Allen | 266/2 R |
| 3,844,845 | 10/1974 | Livingston | 148/2 |
| 3,847,679 | 11/1974 | Livingston | 148/2 |
| 3,975,219 | 8/1976 | Allen et al. | 148/11.5 P |

FOREIGN PATENT DOCUMENTS

| | | |
|---|---|---|
| 895384 | 5/1962 | United Kingdom . |
| 978539 | 12/1964 | United Kingdom . |

*Primary Examiner*—Christopher W. Brody

*Attorney, Agent, or Firm*—Edward A. Steen; Francis J. Mulligan, Jr.

[57] ABSTRACT

A heat treating method for promoting directional recrystallization in objects in general and, more particularly, forgings having relatively low length to thickness ratios. The objects are partially embedded in containers having insulating material therein. The containers are placed into furnaces wherein the rate of the advancing isotherm travelling through the objects are controlled. This process may be used in lieu of zone annealing and static recrystallization heat treatments.

2 Claims, 1 Drawing Sheet

PROMOTING DIRECTIONAL GRAIN GROWTH IN OBJECTS

TECHNICAL FIELD

The present invention relates to heat treatments in general and, more particularly, to a static process for achieving directional recrystallization in articles having relatively low length to thickness ratios.

BACKGROUND ART

Superalloys and heat resistant alloys are materials that exhibit superior mechanical and environmental attack resistance properties at elevated temperatures. Typically, they include as their main constituents: nickel, chromium, cobalt and iron either singly or in combinations thereof. Other materials are added to the alloys to impart additional desired characteristics.

The properties of such alloys are strongly affected by their grain size. At relatively low temperatures, smaller grain sizes are generally acceptable. However, at elevated temperatures (about 1600° F. or 870° C. and higher) creep is usually observed to occur much more rapidly in fine grain materials than in coarse grain materials. Accordingly coarse grain materials are usually preferred for high temperature applications. For example, turbine blades are exposed to hellish environments (about 1800° F. or 980.2° C. or higher) and, as a consequence, require coarse, elongated grain structures.

One method used for improving the properties of an alloy is to form elongated grains. By encouraging grain elongation there are relatively fewer grain boundaries transverse to the stress axis. Elongated grain boundaries appear to improve both the creep and high temperature properties of the alloy.

Oxide dispersion strengthened ("ODS") alloys made by mechanical alloying techniques exhibit superior high temperture rupture strength due to the presence of stable oxide particles in a coarse and highly elongated grain matrix.

A common method for achieving directional recrystallization is called zone annealing. See U.S. Pat. No. 3,746,581 (Cairns, et al). Briefly, zone annealing is routinely applied to constant cross section barstock in order to promote the development of the requisite coarse, elongated grain structure needed for high temperature strength. However, with respect to forgings, which are generally short and irregular, temperature control is difficult. Moreover, thermal gradients in the forgings, an essential feature of zone annealing, are variable and are generally lower than optimum values. It is often a difficult and expensive undertaking to either propel the forging through a distinct temperature zone in a furnace or, conversely, direct a travelling temperature zone across the forging.

SUMMARY OF THE INVENTION

The instant invention involves the use of conventional heat treatment furnaces into which a container containing the object to be treated is placed. The object is embedded into a suitable insulating material so that one end of the object is partially exposed. The exposed end of the object heats up to the predetermined recrystallization temperature first while the sections embedded in the insulation slowly approach this temperature under controlled conditions in a sequence resembling zone annealing. The recrystallization front first appears at the exposed end and then travels along the length of the object at a decreasing velocity.

PREFERRED MODE FOR CARRYING OUT THE INVENTION

Figure 1:
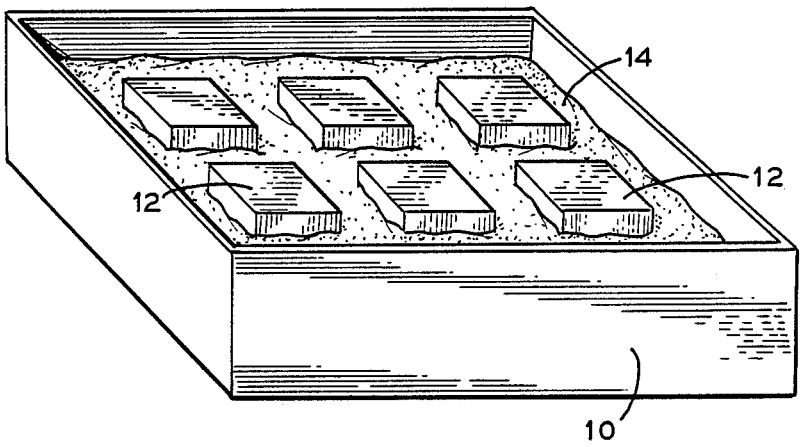
FIG. 1 is a perspective view of an embodiment of the invention.

Referring to FIG. 1, there is shown a container 10 containing a plurality of objects 12. The objects 12, which may be forgings, are embedded in insulating material 14.

Figure 2:
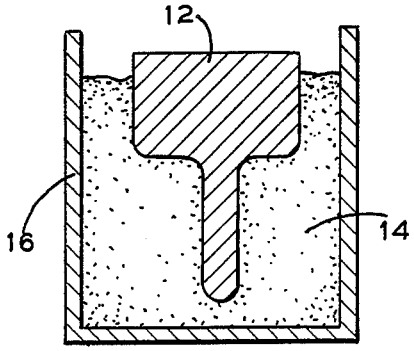
FIG. 2 is a cross-sectional view of an embodiment of the invention.
Figure 3:
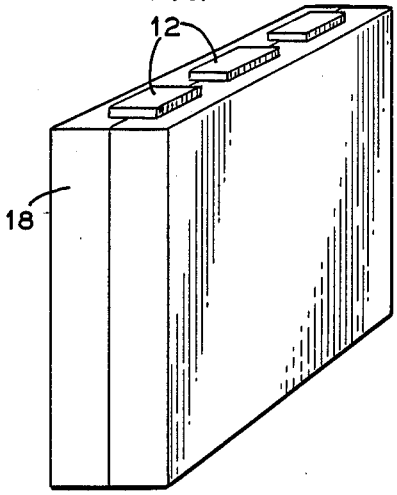
FIG. 3 is a perspective view of an embodiment of the invention.

FIGS. 2 and 3 depict alternative containers 16 and 18.

Since forging and other similarly sized objects 12 are relatively short, having length to thickness ratios of about 5 to 1, it appears possible to encourage directional gain growth in conventional furnaces by insulating the forging 12 (or even a short length of bar) to cause controlled unidirectional heat flow. Some control over gradient and growth rate can be exerted by varying the insulating placement and thickness, selectively positioning the objects, adding chills to the container 12 and using different furnace temperatures.

The instant invention is vastly simpler and more economical than moving heat source methods. The objects 12 would be placed in the container 10, covered to a predetermined height with the insulating material 14 and placed into a furnace. The temperature of the furnace, the insulating material and the protrusion of the object 12 from the insulating material 14 are, of course, functions of the shape of the object 12 and the material from which it is made.

In particular, a turbine blade forging 12, made from an ODS (oxide dispersioned strengthened) alloy, was placed into an alumina crucible 16. See FIG. 2. The crucible 16 was 6 inches (15.24 cm) high with a ¼ inch (0.64 cm) wall thickness. The blade 12 was embedded into zirconia bubble insulation 14 and extended ¼ inches (0.6 cm) above the level thereof. A small quantity (not shown) of Kaowool* insulaton (alumina-silica fiber) was placed at the base of the crucible 12. The furnace was maintained at 2300° F. (1260° C.). Two spaced thermocouples were attached to the blade 12 to monitor the temperature gradient in the blade 12. Two layers of refractory felt (not shown) were placed about the crucible 12 to provide additional insulation. After about an hour, the blade had only partially recrystallized. It was determined that the rate of isotherm travel was too slow because the furnace temperature was too low.

*A trademark.

A second run was conducted in which a slightly larger crucible 16 was utilized. In this instance the insulation 14 was Kaowool insulation and the exposed portion of the blade extended ⅜ (1 cm) inches above the insulation 14. The furnace was maintained at 2350° F. (1290° C.).

Thermocouples revealed a heating rate of 22° F./minute (12° C./minute) which is equivalent to the 150° F./inch (33° C./cm) thermal gradient velocity found in a zone annealing unit travelling at 9 inches/hour (23 cm/hour). Tests indicated that the resultant erratic recrystallization growth was due to flaws in the forgings themselves. Other heat treating methods would have caused similar results due to these flaws.

Other heat treated samples revealed variable results (i.e., good recrystallization except incomplete in the center) which were probably due to improper insulation and blade placement.

A third run was conducted using the alumina crucible (shortened by 2 inches [5 cm]) used in run 2. Zirconia bubbles were used for insulation with a top coating of refractory wool. The blade was exposed to 2350° F. (1290° C.) for thirty-five minutes. The resultant 2200° F. (1205° C.) isotherm velocity was 11.8 inches/hour (30 cm/hour) and the thermal gradient was 63° F./inch (14° C./cm).

The above numbers and results are promising since what appears in the blade root is not believed to be critical. What matters is that the rate of isotherm motion appears to have been controlled without the need for moving the object 12 through a furnace.

The rate of isotherm motion may be modulated by varying the furnace temperature. The tests indicated that the rate of isotherm travel decreased as it travelled further into the object 12. In order to maintain constant isotherm velocity, the temperature of the furnace may be programmed to slowly rise from, say, 2250° F. to 2350° F. (1230° C. to 1290° C.) over a predetermined time period (i.e., 30 minutes). The progressively higher temperature method is capable of maintaining a constant isotherm velocity but may be constrained by the maximum temperature exposure limit of the material being treated.

Another approach would be to use an insulating material 14 that decomposes or is otherwise removed at a rate to engender the desired isotherm velocity. This approach gradually exposes more surface area of the object directly to the heat of the furnace.

FIG. 3 discloses an alernative embodiment of the invention. The objects 12 are inserted into the container 18. A segment of the objects 18 extend from the container 18 for heat exposure. The container 18 may be made from heat insulating material and/or filled with heat insulating material.

The instant method for achieving directional recrystallization in objects is especially well suited for ODS alloy forgings.

While in accordance with the provisions of the statute, there is illustrated and described herein specific embodiments of the invention. Those skilled in the art will understand that changes may be made in the form of the invention and covered by the claims and that certain features of the invention may sometimes be used to advantage without a corresponding use of the other features.

The embodiments of the invention in which an exclusive property or privilege are defined as follows:

1. A furnacing method for generating and controlling the velocity of an advancing isotherm within an object so as to promote directional recrystallization throughout the entire object, the method comprising:

(a) surrounding the object in a stationary heat insulator so that a substantial portion of the object is enveloped by the insulator leaving only a remaining portion exposed, (b) placing the object and insulator in the furnace so that the heat of the furance is directly directed at the exposed portion of the object so as to propagate the isotherm throughout the entire object, and (c) modulating the temprature of the furnace to advance the isotherm through the entire object to cause directional recrystallization therein.

2. The method according to claim 1 wherein the temperature of the furnace is adjusted to regulate the velocity of the isotherm within the object.

* * * * *